US005503085A

United States Patent [19]

Rozek

[11] Patent Number: 5,503,085

[45] Date of Patent: Apr. 2, 1996

[54] PALLET AND METHOD FOR MANUFACTURE

[75] Inventor: Kurt L. Rozek, Portland, Oreg.

[73] Assignee: Mills Pacific Corporation, Portland, Oreg.

[21] Appl. No.: 89,741

[22] Filed: Jul. 12, 1993

[51] Int. Cl.[6] ..... B65D 19/00

[52] U.S. Cl. ..... 108/51.3

[58] Field of Search ..... 108/51.3, 51.1, 108/55.1, 56.1

[56] References Cited

U.S. PATENT DOCUMENTS

| | | | |
|---|---|---|---|
| Re. 34,198 | 3/1993 | Quasnick . | |
| 2,544,743 | 3/1951 | Vrabcak | 108/51.3 |
| 2,928,638 | 3/1960 | Parker . | |
| 2,957,668 | 10/1960 | Norquist et al. . | |
| 3,881,429 | 5/1975 | Seymore . | |
| 3,952,672 | 4/1976 | Gordon et al. . | |
| 4,185,565 | 1/1980 | Nymoen . | |
| 4,228,744 | 10/1980 | Moore . | |
| 4,563,377 | 1/1986 | Melli . | |
| 4,714,026 | 12/1987 | Yamaguchi et al. | 108/51.3 X |
| 4,717,025 | 1/1988 | Mavron | 108/51.3 X |
| 4,792,325 | 12/1988 | Schmidtke . | |
| 4,867,074 | 9/1989 | Quasnick . | |
| 4,966,084 | 10/1990 | Motomaru . | |
| 4,979,446 | 12/1993 | Winebarger . | |
| 5,001,991 | 3/1991 | Smith . | |
| 5,083,996 | 1/1992 | Smith . | |
| 5,154,687 | 10/1992 | Jeslis . | |
| 5,213,050 | 5/1993 | Juvikwoods | 108/51.3 |
| 5,222,444 | 6/1993 | Youell, Jr. et al. . | |
| 5,285,731 | 2/1994 | McIntyre | 108/51.3 |

FOREIGN PATENT DOCUMENTS

| | | | |
|---|---|---|---|
| 4034481 | 5/1992 | Germany | 108/51.3 |
| 120061 | 7/1992 | WIPO | 108/51.3 |

*Primary Examiner*—José V. Chen

*Attorney, Agent, or Firm*—Klarquist, Sparkman, Campbell, Leigh & Whinston

[57] ABSTRACT

A pallet constructed of a base sheet of material formed to provide elongate, laterally spaced, channel-shaped support members and projecting outer edge margin portions. Elongate reinforcing beams of folded sheet material and upright cylindrical tubular members are placed in the support members to reinforce the base portion. A platform sheet overlies the base sheet and reinforcing members, with end margin portions of the platform sheet extending outwardly beyond opposite ends of the base sheet. The outer edge margin portions of the base are folded downwardly onto the top of the platform sheet and adhered thereto for transverse reinforcing. The end margin portions of the platform sheet may be folded upwardly at a substantial angle relative to remainder portions of the platform sheet to provide reinforcing between the spaced support members. Openings are produced in the undersides of the channel members and reinforcing members to permit the forks of a forklift truck or other lifting structure to be inserted transversely of the pallet. A method for producing such a pallet also is disclosed.

9 Claims, 2 Drawing Sheets

FIG. 3
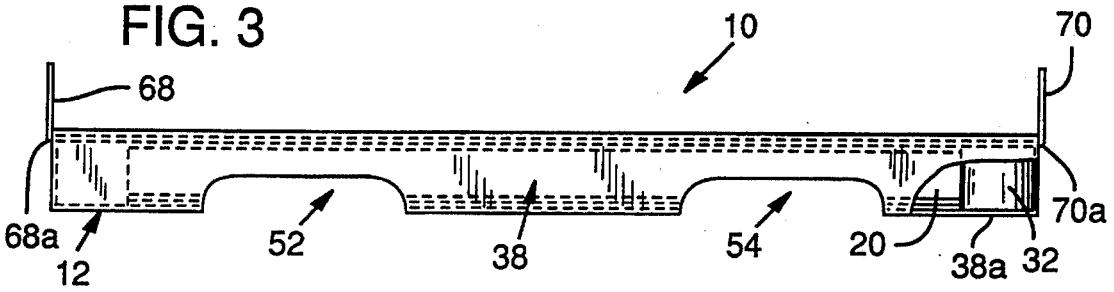
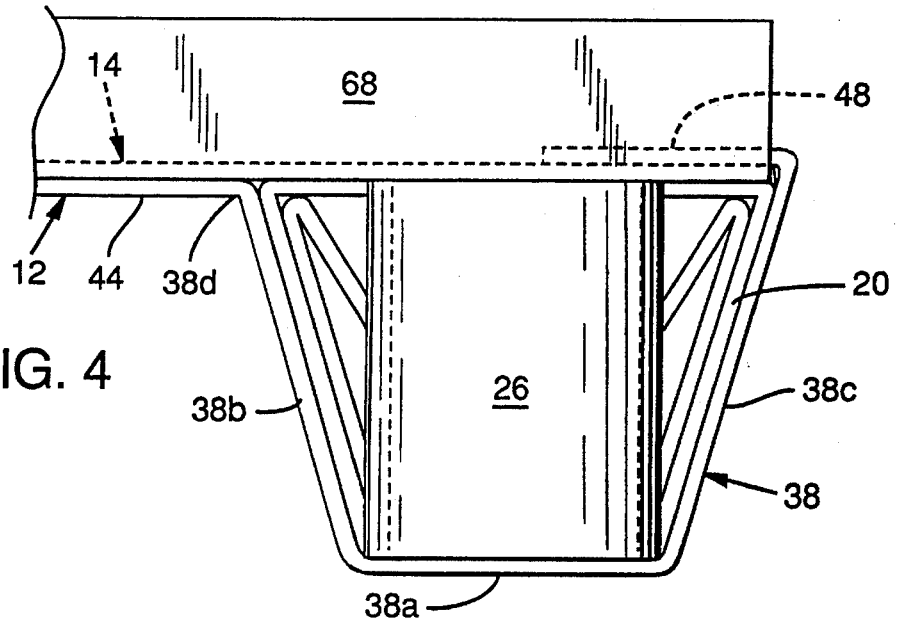
FIG. 4
FIG. 5
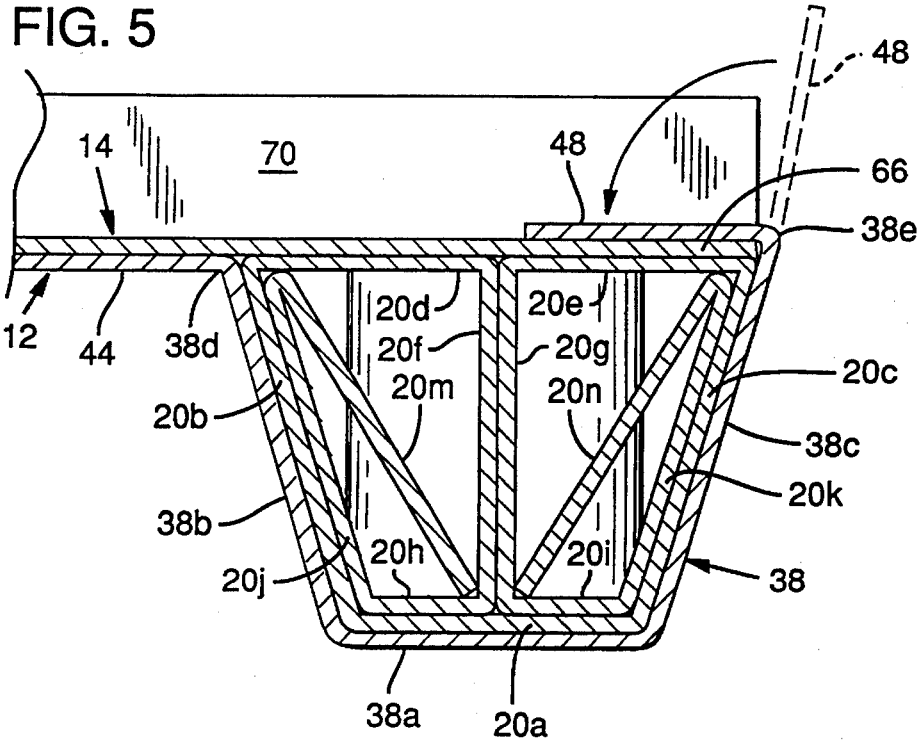

PALLET AND METHOD FOR MANUFACTURE

This invention relates to a pallet made of sheet material, and a method for producing the same.

BACKGROUND AND SUMMARY OF THE INVENTION

Pallets made of sheet material, such as corrugated fiberboard or paperboard, are known in the art and have been commercially available previously. Such are disclosed, for example, in U.S. Pat. Nos. 4,185,565 to Nymoen; 4,563,377 to Melli; and 4,867,074 to Quasnick. Methods and equipment for manufacturing such pallets, or parts therefor, are disclosed, for example, in U.S. Pat. Nos. 5,083,996 to Smith; and 5,154,687 to Jeslis.

Such prior devices and methods of manufacturing the same have not been totally satisfactory since they often require the forming of a number of multiple fold beam elements which are disposed and secured substantially normal to each other to define an open gridwork for supporting a load. Such prior pallets which have normally disposed elongate beams extending transversely of each other, as in Quasnick, provide spaces between the gridwork of beams, which may not provide adequate support for a load, and also are expensive to produce.

Where a pallet has been disclosed with upper and lower sheet elements and support members defined therein, such as in Nymoen, there have been concerns for strength and stability of the elements under the effects of heavy loads and rough handling. For example, the Nymoen disclosure merely has upper and lower sheet members secured together spanning the space between channel members, which may be insufficient to support loads which do not fully span the distance between the channel members. For example, a load which rests only between the spaced channel members in Nymoen could produce substantial buckling, or cupping, of the platform.

Accordingly, it is an object of the present invention to provide a novel pallet, made of sheet material, such as corrugated fiberboard, paperboard, or other light material, which is economical to manufacture, yet which provides substantial load supporting strength and stability.

Another object of the present invention is to provide a novel pallet made of sheet material which has a platform sheet secured to and supported by two or more spaced support members, with an end margin portion of the platform sheet which substantially spans the space between the support members adapted to be folded into a position extending at a substantial angle relative to remainder portions of the platform sheet to provide added load carrying strength in the space between the support members.

A further object of the present invention is to provide a simple and economically constructed pallet of sheet material, which includes a base sheet having at least a pair of spaced elongate channel members extending longitudinally of the base, with a platform sheet overlying and secured to the base. A marginal edge portion of the base is wrapped over and secured to the upper surface of a side edge margin of the platform sheet. This wrap-over construction adds columnar strength to the channel members adjacent the outer edges of the pallet permitting them to sustain and resist forces imposed upon the pallet, such as sideways forces resulting from using a forklift to position the pallet. The wrap-over feature also serves to strengthen the securing of the platform sheet to the base sheet without requiring additional tooling or machining.

Yet another object of the present invention is to provide a novel pallet having a base sheet with elongate channel members formed therein extending longitudinally of the base, which channel members have reinforcing members therein extending from a bottom wall of the channel member to the platform sheet overlying the channel.

A still further object of the present invention is to provide such a novel pallet wherein the reinforcing members include substantially rigid tubes disposed in an upright position in the channel members. The tubes have good resistance to compression, and thus aid in supporting loads placed on the platform sheet.

Another object of the present invention is to provide a novel method for the manufacture of such a pallet which includes the steps of forming a base sheet having elongate channel sections, forming a platform sheet which is placed on the base sheet, and folding side edge margins of the base sheet over side edges of the platform sheet and securing them thereto.

Further, a method is provided for producing a pallet which includes the steps of forming a base from a sheet of material by producing multiple folds in the sheet to provide at least two spaced support members depending from remainder portions of the sheet, forming a platform sheet having a width sufficient to span the distance between the support members, folding an end edge margin portion of the platform sheet at a substantial angle relative to remainder portions of the platform sheet, and securing the platform sheet on the base with the end edge margin portion spanning the space between support members.

These and other objects and features of the invention will become more clearly apparent as the following description is read in conjunction with the drawings.

BRIEF DESCRIPTION OF THE DRAWINGS

FIG. 3 is a side elevation view of the pallet illustrated in FIG. 1 with a portion broken away.

FIG. 4 is an enlarged view taken generally along line 4—4 in FIG. 1.

FIG. 5 is an enlarged cross-sectional view taken generally along line 5—5 in FIG. 1.

DETAILED DESCRIPTION OF AN EMBODIMENT OF THE INVENTION

Figure 1:
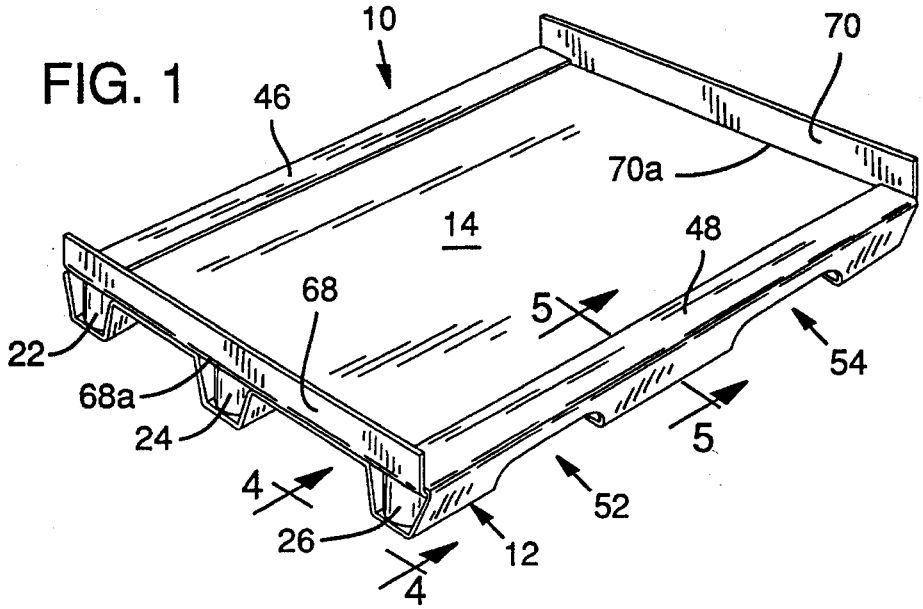
FIG 1 is a perspective view of a pallet constructed according to an embodiment of the invention.
Figure 2:
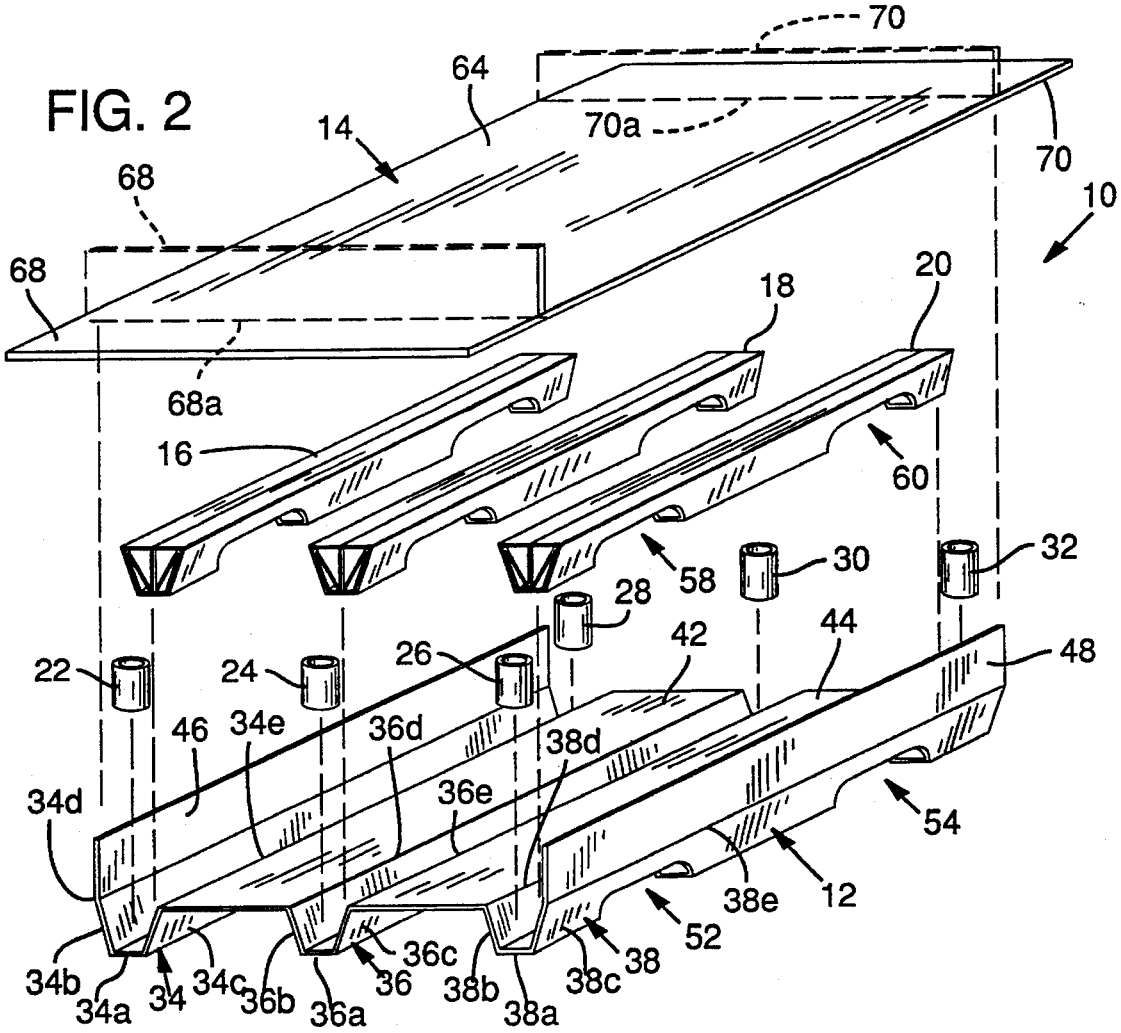
FIG. 2 is an exploded perspective view of the pallet of FIGS. 1 illustrating component parts of such pallet.

Referring to FIG. 1, a pallet constructed according to an embodiment of the invention is indicated generally at 10. The basic components of the pallet, as illustrated in FIGS. 1 and 2 include a base, or base sheet, 12, an overlying platform sheet 14, and a plurality of reinforcing members in the form of elongate beams 16, 18, 20 and upright cylindrical tubes 22, 24, 26, 28, 30, 32.

Referring first to the base, it is formed of a single sheet of material, such as corrugated fiberboard, paperboard, or like material. One example of sheet material which may be used is 200 lb. bursting strength 'C' flute corrugated fiberboard with a minimum edge crush of 32 lb. per inch width. In the illustrated embodiment, it is folded along fold lines extending longitudinally of the sheet to form three elongate channel members 34, 36, 38. Each channel member has a bottom wall 34*a*, 36*a*, 38*a* and a pair of slightly diverging, substantially upright sidewalls 34*b*, 34*c*; 36*b*, 36*c*; 38*b*, 38*c* which depend from remainder portions of the sheet. The sidewalls have longitudinally extending upper edges 34*d*, 34*e*; 36*d*, 36*e*; and 38*d*, 38*e*. Substantially planar intermediate portions 42, 44 of the base sheet join to and extend between upper edges 34*e*, 36*d* and 36*e*, 38*d* of the channel members, respectively.

Longitudinally extending marginal edge portions 46, 48 of the base sheet extend beyond upper edges 34*d*, 38*e*, respectively.

Contiguous portions of the bottom walls and sidewalls of each channel member are removed to form openings, such as those indicated generally at 52, 54. Such openings are formed in each of the channel members and are aligned transversely of the base.

Referring to FIG. 2, beams 16, 18, 20 are constructed to fit in channel members 34, 36, 38, respectively. The beams are similar in construction, and thus only beam 20, illustrated in cross-section in FIG. 5, will be described in detail. As is known, a substantially rigid beam may be formed of folded sheet material. In this instance, an elongate sheet of corrugated fiberboard, paperboard, or like material is folded along substantially parallel lines extending longitudinally of a sheet to form an outer base wall 20*a*, a pair of opposed diverging outer sidewalls 20*b*, 20*c*, inwardly extending upper walls 20*d*, 20*e*, upright, contiguous mating walls 20*f*, 20*g*, inner base walls 20*h*, 20*i* resting atop outer base wall 20*a*, inner diverging sidewalls 20*j*, 20*k* resting against walls 20*b*, 20*c*, respectively, and diagonal braces 20*m*, 20*n*, respectively.

Openings 58, 60 are formed in beam 20, which will align with openings 52, 54 when the beam is inserted into its associated channel member 38 as illustrated in FIGS. 3 and 5. Openings in the undersides of beam members 16, 18 likewise are formed to align with openings in the undersides of their associated channel members, with beam 16 being adapted to rest in channel member 34, and beam 18 being adapted to rest in channel member 36.

The beams are of a configuration to rest snugly in their associated channel members with their upper walls, such as 20*d*, 20*e*, aligned with, and in substantially the same plane as, intermediate portions 42, 44 of the base member. The beams 16, 18, 20 also are shorter than the length of the channel members, allowing space for tubes 22, 24, 26 to be placed in the channel members adjacent the near end of the pallet, as illustrated in FIGS. 1 and 2, and tube members 28, 30, 32 to be placed in the channel members at the opposite end of the pallet.

Referring to FIG. 4, and specifically to tube 26, it is a substantially cylindrical, hollow tubular element produced of convolutely or spirally wound paper, or like material, which has a diameter which rests easily within the base of its associated channel member 38. The tube has a height whereby its upper surface lies substantially in the plane of the top of intermediate portions 42, 44.

Platform sheet 14 is a substantially rectangular sheet of corrugated fiberboard, paperboard, or like material, which spans the distance between the channel members and has a side-to-side width which fits comfortably between upper edges 34*d*, 38*e* of the outer channel members of the base sheet. The platform sheet may be made of material similar to that used to produce base sheet 12. Side edge margin portions 64, 66 at opposite sides of the platform sheet overlie channel members 34, 38, and their associated beams 16, 20, respectively. Opposite end edge margin portions 68, 70 extend longitudinally outwardly beyond opposite ends of the base 12 with scored fold lines 68*a*, 70*a* overlying the end edges of base 12, as seen in dashed line in FIG. 2. These end edge margin portions 68, 70 are adapted to be folded upwardly along fold lines 68*a*, 70*a*, to project substantially perpendicular, or normal, to remainder portions of sheet 14, as shown in solid lines in FIGS. 1 and 3–5, and in dotted line in FIG. 2.

The pallet is assembled by placing elongate beams 16, 18, 20 and tubes 22, 24, 26, 28, 30, 32 in their appropriate positions in channel members 34, 36, 38 and securing them therein. Known adhesives may be used to secure the beams and tubes in the channel members. The platform sheet 14 is placed atop the base sheet, beam members and tube members, and secured thereto, as by adhesive bonding. The marginal edge portions, 46, 48, of the base sheet, which originally had been in the position illustrated in dashed outline in FIG. 5, then are bent over to lie flat against the upper surface of the side edge margin portions of the platform sheet, as illustrated in FIG. 1 and in solid outline in FIG. 5. They also are secured to the top surface of the platform sheet, as by the application of appropriate adhesive herebetween.

A method for producing such a pallet includes initially the step of providing a substantially rectangular base sheet 12. Lines are scored extending longitudinally of the sheet where folds, or bends, are required, to produce the desired configuration. The base sheet then is folded along the appropriate scored lines to produce the configuration previously described and as illustrated in the drawings.

Sheets of corrugated material to form elongate beams 16, 18, 20 are provided. These sheets are scored and folded to the configurations described above.

The cylindrical tubular members are formed in the illustrated cylindrical configuration of convulately or spirally wound paper, or like material, of an appropriate length to fit within the channel members. The beam members and tubular members are inserted into the channel members and secured therein, as by adhesive bonding.

After the beams are inserted in their respective channel members, appropriate cutters are used to cut openings, such as those noted at 52, 54, 58, 60, in all of the channel members and beams.

An alternate method for producing openings, such as those at 52, 54, 58 and 60, is to cut appropriately placed apertures in the sheets forming base 12 and beams 16, 18, 20, when they are flat, whereby when the sheets are folded as illustrated herein the apertures will be properly positioned to form the openings.

The upper platform sheet is produced by providing a substantially rectangular sheet having a side-to-side width less than, or equal to, the distance between 34*d*, 38*e*, as illustrated, and having a length equal to the length of base sheet 12 as illustrated in FIGS. 1 and 2, 10 plus the added lengths of opposed end edge margin portions 68, 70. The platform sheet is scored along lines 68*a*, 70*a*, but remains flat throughout production.

The platform sheet is placed against the tops of the base sheet and support members and is adhered thereto. Marginal edge portions 46, 48 of base member 12 then are folded over onto the side edge margins 64, 66 of the platform sheet 14 and adhered thereto.

A pallet thus is produced which is lightweight, and economically manufactured. It is adapted to support substantial loads in relation to its weight.

The end edge margin portions of the platform sheet 68, 70, are turned upwardly from remainder portions of the platform sheet along lines 68*a*, 70*a* prior to, or subsequent to loading by a user. These are also referred to as flex flaps. With these flex flaps folded up at right angles relative to the platform sheet, they add reinforcing to the deck to inhibit buckling or sagging under heavy loads. For example, if a heavy item were placed on a pallet without such flex flaps, and the item was of a size that did not bridge the distance between the channel members, buckling or sagging may occur therebetween. Further, if a forklift or pallet jack is used to lift the pallet, the lifting members thereof extend into the spaces between the channel members, and upon lifting could cause the outside channel members, or runners, to fold downwardly outside the lifting members. In either case, the pallet would fail at its intended purpose of supporting and holding the load.

The end edge margins, or flex flaps, 68, 70 have been found to provide substantial reinforcing against such deformation of the pallet under load. The flex flaps also provide a degree of protection against products on the pallet being cut by strapping or banding which may be wrapped around the pallet and its accompanying load to secure the load on the pallet. 10 The marginal edge portions 46, 48 of the base sheet, also referred to as bottom wraps, simplify the pallet assembly construction and add strength to the channel members, or runners, 34, 38. Folding the marginal edge portions, or bottom wraps, inwardly and securing them to the platform sheet overlying the outer channel members increases the ability of the pallet to withstand forces from loads on the pallet and laterally applied forces resulting from use of a forklift to position a pallet. The internal beams and tubes further strengthen the channel members, or runners, and support the platform sheet when loaded.

While a preferred embodiment of the invention has been described herein, it should be apparent to those skilled in the art that variations and modifications are possible without departing from the spirit of the invention.

I claim:

1. A pallet comprising at least two elongated, substantially parallel spaced support members defining a substantially unimpeded space therebetween adapted to receive an elongate lifting element, and a platform sheet secured to and supported by said support members, said platform sheet spanning the space between said support members and having at least one end margin portion which extends normal to said support members, spans the space between said support members and is folded into a position extending upwardly from remainder portions of said platform sheet at a substantial angle relative to remainder portions of the platform sheet to provide reinforcement against deformation and retain an opening between the support members to receive an elongate lifting element.

2. The pallet of claim 1, wherein said end margin portion extends in an unbroken expanse substantially the full width of the pallet.

3. A pallet comprising a base constructed of a sheet of material having at least a pair of spaced elongate channel members having marginal edge portions projecting therefrom, and a platform sheet having an upper surface facing away from said base and a side edge margin, said platform sheet extending over said base and secured thereto with a marginal edge portion of a channel member being folded over and secured to the upper surface of said platform sheet, said platform sheet further having an end margin portion which spans the space between said support members and is folded into a position extending upwardly at a substantial angle relative to remainder portions of the platform sheet.

4. The pallet of claim 3, wherein a reinforcing member is mounted in a channel.

5. The pallet of claim 4, wherein said reinforcing member comprises an elongate beam constructed of a folded sheet of material.

6. The pallet of claim 4, wherein said reinforcing member comprises a substantially rigid tube disposed in an upright position within said channel member.

7. A pallet comprising a base constructed of a sheet of material having at least a pair of spaced elongate hollow substantially parallel channel members extending longitudinally of the base and defining a substantially unimpeded space therebetween adapted to receive an elongate lifting element extending longitudinally of the channel members, each channel member having a bottom wall and opposed substantially upright sidewalls, a platform sheet extending over said base and secured thereto with said channel members underlying said platform sheet to support the platform sheet in an elevated position, and an elongate reinforcing member secured in said channel member extending from the bottom wall to the platform sheet along the length of the channel members, the bottom wall and sidewalls of each said channel member and said reinforcing member having contiguous portions removed to form a Bottomless opening to receive a lifting element extending transversely of said channel through a major portion of the width of the pallet member.

8. The pallet of claim 7, wherein said reinforcing member comprises an elongate beam constructed of a folded sheet of material which rests in a channel member, and said opening is formed in the lower portion of said beam.

9. A method for producing a pallet comprising the steps of forming a base from a sheet of material by producing multiple folds in said sheet to form at least two elongate substantially parallel spaced support members depending from remainder portions of the sheet and defining a substantially unimpeded space therebetween adapted to receive an elongate lifting element, forming a platform sheet having a width sufficient to span the distance between said support members and having opposed end edge portions, securing said platform sheet on said base with an end edge margin portion spanning the space between said support members, and folding said end edge margin portion of said platform sheet at a substantial angle upwardly relative to remainder portions of said platform sheet to a position extending substantially normal to remainder portions of said platform sheet and substantially normal to said support members to provide reinforcement against deformation during pallet use.

* * * * *